US010264893B2

(12) United States Patent
Keilhauer

(10) Patent No.: US 10,264,893 B2
(45) Date of Patent: Apr. 23, 2019

(54) SWING ARM MECHANISM FOR TABLET CHAIR

(71) Applicant: Keilhauer Ltd., Toronto (Ontario) (CA)

(72) Inventor: Steve Keilhauer, Toronto (CA)

(73) Assignee: KEILHAUER LTD., Toronto (CA)

( * ) Notice: Subject to any disclaimer, the term of this patent is extended or adjusted under 35 U.S.C. 154(b) by 88 days.

(21) Appl. No.: 15/180,209

(22) Filed: Jun. 13, 2016

(65) Prior Publication Data

US 2017/0013963 A1 Jan. 19, 2017

(30) Foreign Application Priority Data

Jul. 15, 2015 (CA) ..... 2897295

(51) Int. Cl.
*A47C 7/68* (2006.01)
*A47C 7/00* (2006.01)
*A47C 3/18* (2006.01)

(52) U.S. Cl.
CPC ..... *A47C 7/68* (2013.01); *A47C 3/18* (2013.01); *A47C 7/004* (2013.01); *A47C 7/006* (2013.01)

(58) Field of Classification Search
CPC ..... A47C 7/68
See application file for complete search history.

(56) References Cited

U.S. PATENT DOCUMENTS 4,645,167 A 2/1987 Hardwick
5,074,615 A 12/1991 Honig
5,169,210 A 12/1992 Fricano
5,931,528 A 8/1999 Shields
7,380,886 B1 * 6/2008 Copello ..... B60N 2/767 297/411.35
2004/0113337 A1 * 6/2004 Landry, Jr. ..... F16F 1/3873 267/141
2008/0231091 A1 9/2008 Goranson
2011/0187164 A1 * 8/2011 Corcorran ..... A47B 39/00 297/170
2012/0267923 A1 10/2012 Bouche
2013/0049410 A1 * 2/2013 Stafford ..... A47C 3/18 297/16.1
2015/0241041 A1 * 8/2015 Youngberg ..... A47B 96/025 362/249.1
2016/0022043 A1 * 1/2016 Czumaj-Bront ..... A47C 7/004 297/172
2017/0208952 A1 * 7/2017 Simon ..... A47C 7/68

OTHER PUBLICATIONS

Vivero OPPI Originals, pp. 1-6 (info@vivero.fi).

* cited by examiner

*Primary Examiner* — Timothy J Brindley
(74) *Attorney, Agent, or Firm* — Patterson + Sheridan, LLP

(57) ABSTRACT

On an article of furniture, a bearing assembly is disposed between an elongate central structure and a seat, which permits rotation between the seat and the base. A tablet is provided, which is connected to a tablet arm with a first cylindrical member, and the tablet arm is connected to the elongate central structure of the base with a second cylindrical member. The second cylindrical member is disposed around the elongate central structure with a flange at the upper end thereof. The bottom of the seat has a lobed friction bushing disposed such that the flange of the second cylindrical member contacts the lobed friction bushing and frictionally resists rotation of the tablet arm as the seat rotates 360 degrees relative to the base, leading the tablet to follow the seat as it rotates. A lobed friction bushing is also provided.

12 Claims, 12 Drawing Sheets

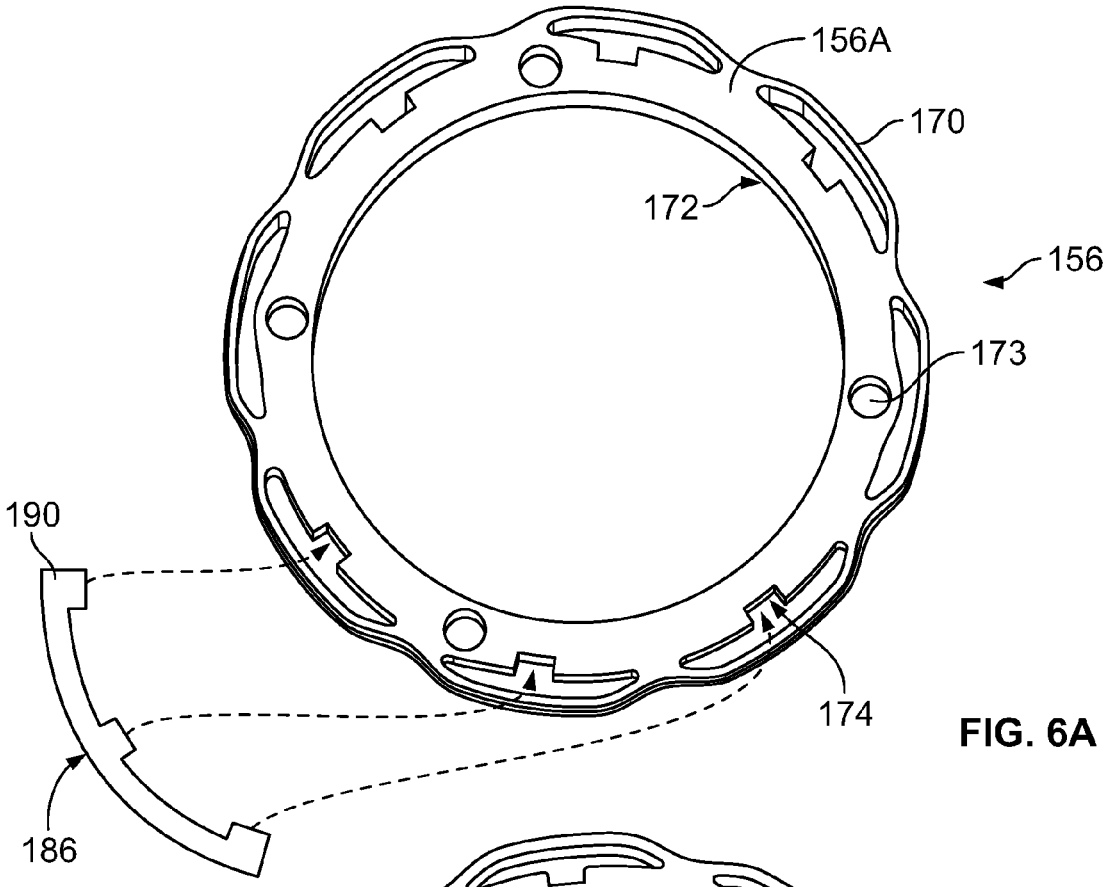
FIG. 6A
FIG. 6C
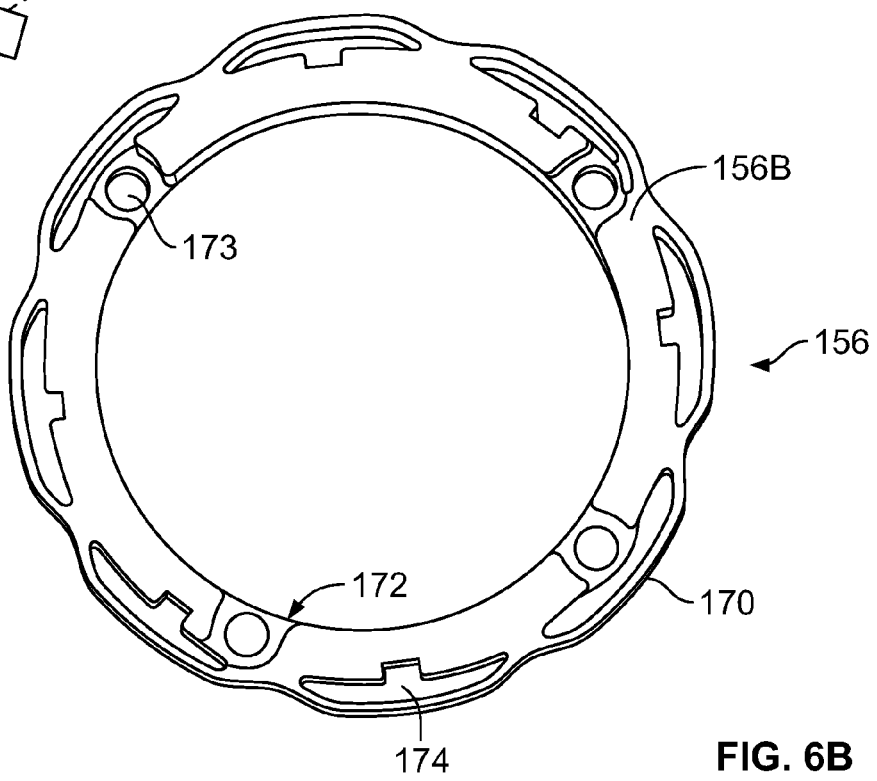
FIG. 6B

SWING ARM MECHANISM FOR TABLET CHAIR

CROSS-REFERENCE TO RELATED APPLICATIONS

This application claims benefit of Canadian patent application number 2,897,295, filed Jul. 15, 2015, which is herein incorporated by reference.

FIELD OF THE INVENTION

The invention relates to chairs, and more particularly, to chairs with a tablet feature.

BACKGROUND OF THE INVENTION

Description of the Related Art

Chairs with a built in tablet feature have been known for many years, for example as student desk/chair combinations. More recently, tablet chairs have moved beyond this humble utilitarian context and have become popular as lounge furniture. In this context, the tablet can be used to hold small food or beverage items, a book, a newspaper, or a computer or other electronic device.

In the early familiar models of student/desk chair combinations, the tablet arm was largely built as a rigid fixture, to maximize durability against vandalism and hard-wear with less emphasis on user comfort and convenience. One of the problems with these fixed arm models is that the user must adapt his body around the tablet in order to sit down in the chair or get up from the chair, and there is no option to move the tablet out of the way. This is inconvenient and uncomfortable for users.

In the context of lounge seating, versatility and comfort are important considerations together with durability and hard-wear. Although some existing tablet chairs allow the tablet arm or the tablet itself to slide or rotate between a service and a non-service position relative to the user, they do not necessarily allow a full range of selectable positioning options. Some models provide a stowable tablet, using a hinge for vertical storage. However, while practical for space-saving, such solutions require more moving parts (e.g. locking or latching mechanisms), which can get worn or jam. Further, stowable tablets are typically right- or left-handed exclusively, rather than ambidextrous. And stowable tablets may interfere with full availability and/or use of arm rests.

It would be desirable to provide a swing arm mechanism for a tablet chair that permits maximum flexibility and versatility for positioning of the tablet or moving it completely out of the user's way. Such positioning would also permit the user to set the tablet and/or its arm in a position and maintain that position and that relative orientation over a range of rotation of the seat and resist small disturbances and forces (e.g. incidental contact with the user's knees or arms).

SUMMARY OF THE INVENTION

According to a first aspect of the invention, an article of furniture is provided. The article includes a seat which has a first surface facing a user and a second surface opposite the first surface. A base is provided which has an elongate central structure. A bearing assembly is provided between the elongate central structure of the base and the seat. The bearing assembly permits rotation between the seat and the base. A tablet is provided. A tablet arm is connected to the tablet with a first cylindrical member and to the elongate central structure of the base with a second cylindrical member. The second cylindrical member is disposed around the elongate central structure with a flange at the upper end thereof. The seat has a lobed friction bushing on the second surface, which is disposed such that the flange of the second cylindrical member contacts the lobed friction bushing and frictionally resists rotation of the tablet arm as the seat rotates 360 degrees relative to the base, leading the tablet to follow the seat as it rotates.

Preferably, the tablet arm includes a clocking element on the second cylindrical member. This clocking element catches on at least one other element attached to the second surface of the seat for retaining the relative orientation of the tablet as the seat rotates.

In certain embodiments, the tablet arm may be rotatable across a range from right to left, including a position top dead centre of the position of the user. In certain embodiments, the tablet arm may be rotatable to a position behind the user. Preferably, the tablet arm is rotatable over 360 degrees.

In other embodiments, including the "clocking" embodiment above, the tablet arm may be rotatable within a range circumscribed by the at least one element on the seat.

The tablet preferably has a first surface facing the user and a second surface opposite the first surface. A lobed friction bushing is disposed on the second surface of the tablet such that a flange at an upper end of the first cylindrical member contacts this lobed friction bushing and frictionally resists rotation of the tablet as the tablet arm is rotated relative to the base, leading the tablet to follow the tablet arm as it rotates.

Preferably, the tablet is movable independently of the rotation of the seat. Preferably, the relative position of the tablet is maintained as the seat rotates.

In one embodiment, the lobed friction bushing is a unitary ring or disc which has a plurality of radially outwardly extending compressible lobes around its perimeter, at least an outer portion of each lobe engaging with an interior diameter of the flange.

The lobed friction bushing may also include at least one insert having a flat surface layer and a plurality of projections extending proud thereof. Each projection engages a gap within a corresponding lobe on the unitary ring or disc to support and prevent memory set of the lobe.

According to a second aspect of the invention, a lobed friction bushing is provided for use as a resistance bearing in a rotatable coupling in a furniture item (of the type that has a first part that is relatively fixed and a second part that is relatively rotatable therewith). The bushing may be made up of a unitary ring or disc having a plurality of radially outwardly extending compressible lobes around its perimeter. Each lobe provides an engagement surface for engaging an interior diameter of the second part. The ring or disc defines an interior bore with a smooth diameter for receiving the first part, such that the ring or disc moves independently of the first part but slides with some resistance against the second part.

The bushing may further comprise at least one insert which has a flat surface layer and a plurality of projections extending proud thereof. Each projection engages a gap within a corresponding lobe on the unitary ring or disc to support and prevent memory set of the lobe.

Preferably, the lobed friction bushing is of a compressible material, which in one embodiment includes a smooth plastic.

BRIEF DESCRIPTION OF THE DRAWINGS

FIG. 6A is a detailed top view of a large lobed friction bushing according to a preferred embodiment.

FIG. 6B is a detailed bottom view of the large lobed friction bushing.

FIG. 6C is a detailed view of insert 186 for assembly with the large lobed friction bushing shown in FIG. 6A.

DETAILED DESCRIPTION

Figure 1A:
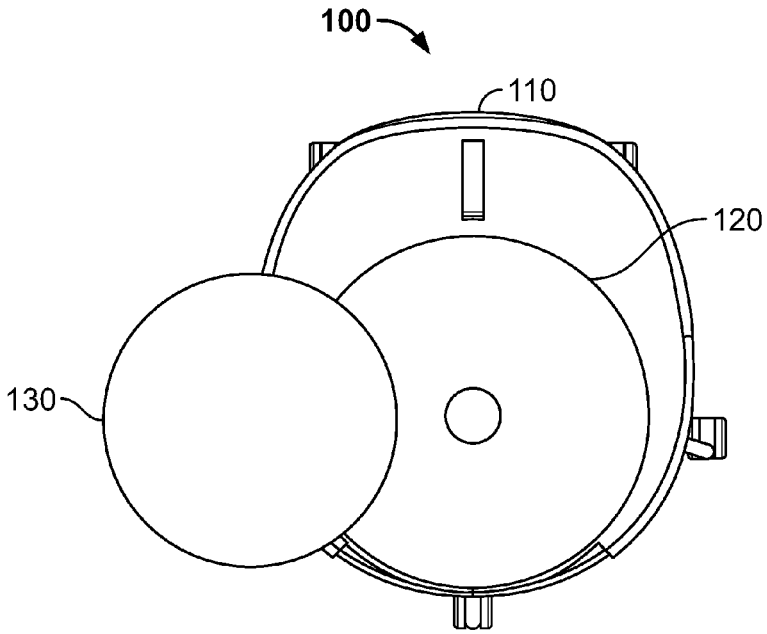
FIG. 1A is a top view of a tablet chair according to a preferred embodiment.
Figure 1B:
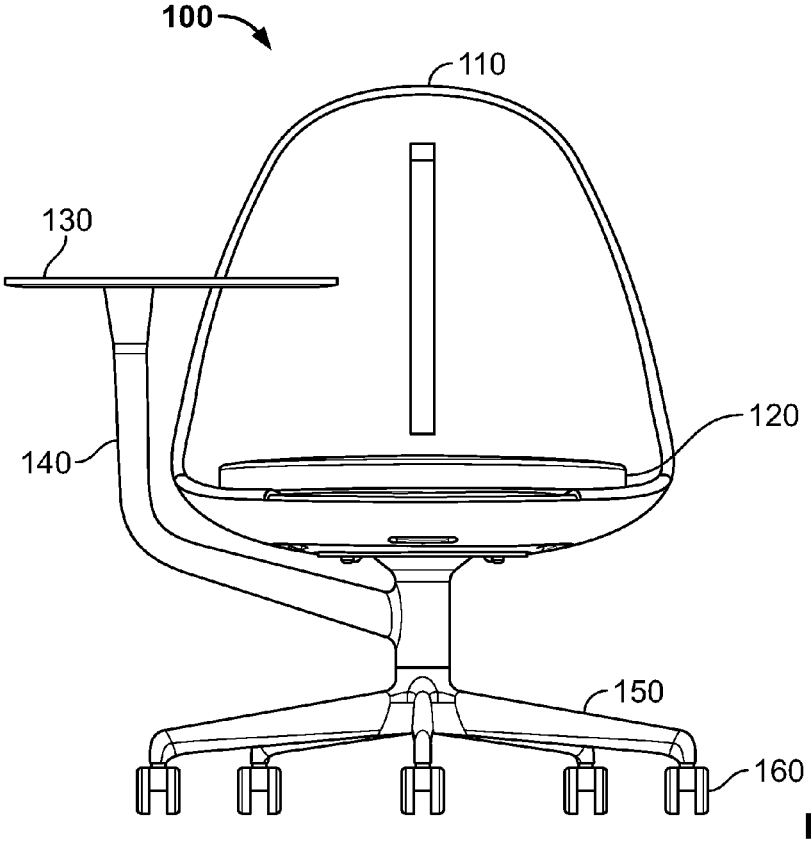
FIG. 1B is a front view of the tablet chair of FIG. 1A.
Figure 2A:
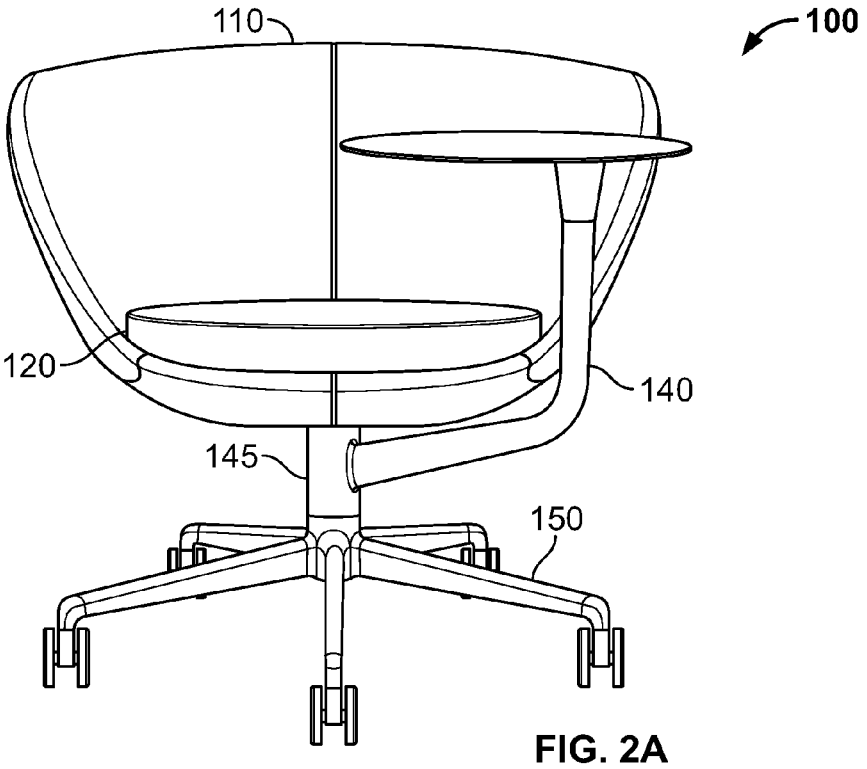
FIG. 2A is a front perspective view of the tablet chair with tablet in a selected position swiveled to the front and side.
Figure 2B:
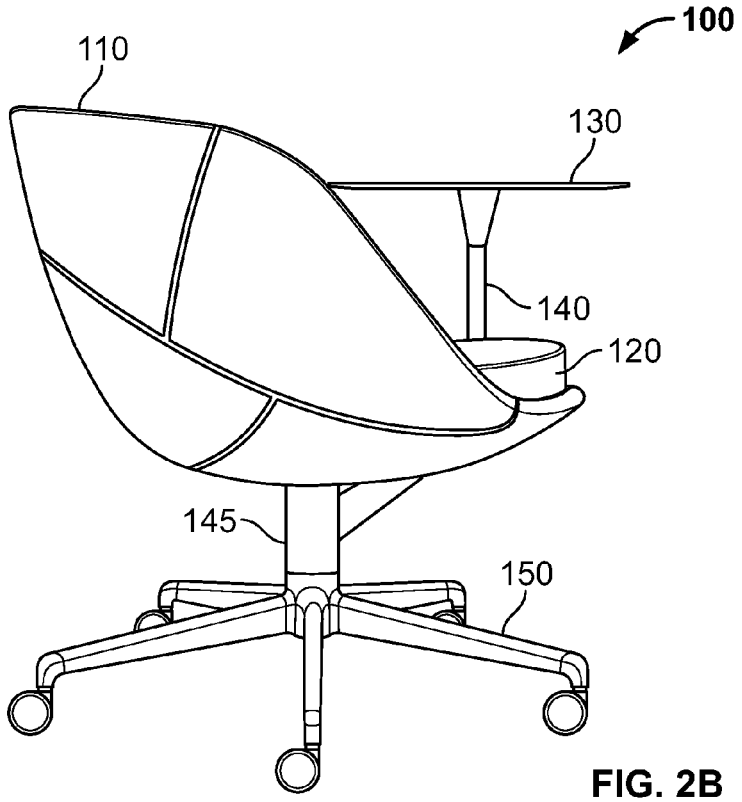
FIG. 2B is a rear-side perspective view of the tablet chair of FIG. 2A with tablet arm shown staying in the same relative orientation to the front of the chair.

The tablet chair has generally a chair component and a tablet component. The tablet is attached to the chair by means of a tablet arm.

Some of the positions possible in the tablet chair are shown in FIGS. 1A, 1B, 2A and 2B. The arm is preferably positionable in an arc around at least the front of the chair. In some configurations, for example, a backless stool (not shown), the tablet may be rotatable fully around the chair. The tablet itself is preferably fully rotatable on its arm.

As shown in the Figures, in one embodiment, the chair 100 has a seat structure 110, a seat portion 120 and a tablet portion 130. The chair has a base portion. The tablet arm 140 connects the tablet portion 130 to the base portion 150 of the chair. A four- or five-point "star" base is shown as one typical embodiment. However, it will be appreciated that various types of bases may be provided in various configurations (and may include or omit, for example, wheels or rollers 160).

Figure 3:
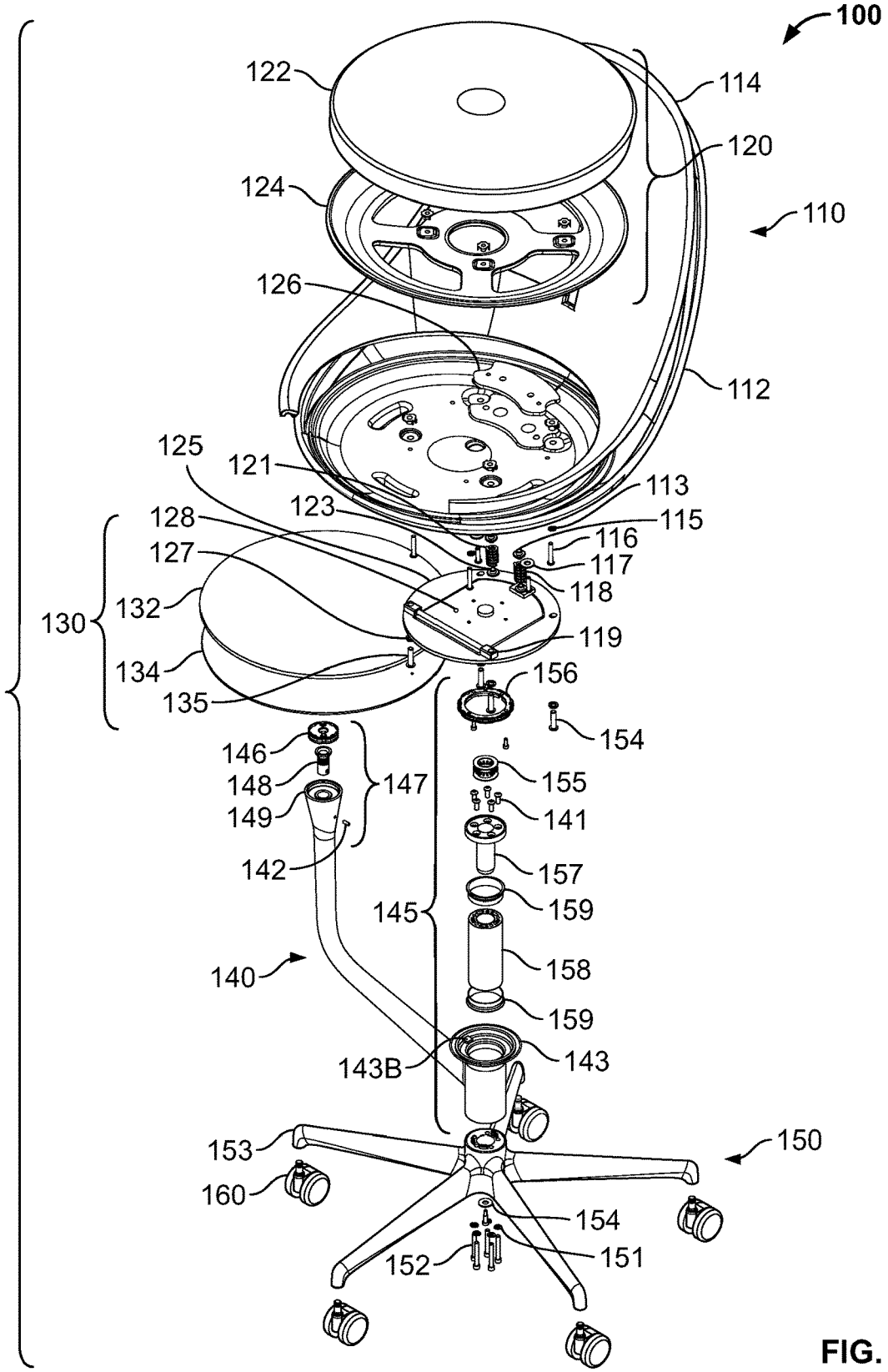
FIG. 3 is an exploded diagram showing assembly of the chair and tablet arm with tablet.

Looking at FIG. 3, chair 100 has a seat assembly 120 which is disposed on a seat structure 110. As shown, a tub-shaped seat structure may be provided which includes a chair body 112. The chair body 112 may be upholstered with a foam padding 114. The seat assembly 120 preferably has a seat pan 124 with a foam seat pad 122. The seat pan 124 is assembled to the chair body 112. Tilt plate 126 provides a surface against which springs 121 may tilt. Under the chair body 112, pivot mount plate 125 is coupled to chair body 112 via screws 135, and washers 127. On pivot mount plate is disposed seat mount 128, which includes hinge bushing 119 and spring assemblies (die spring 121, shoulder washer 123, spring holder 115 retained by screws 116, 118, and washers 113, 117). The springs are sandwiched between tilt plate 126 and seat mount 128 and enable a small range of tilt action of the seat structure 110.

Figure 4:
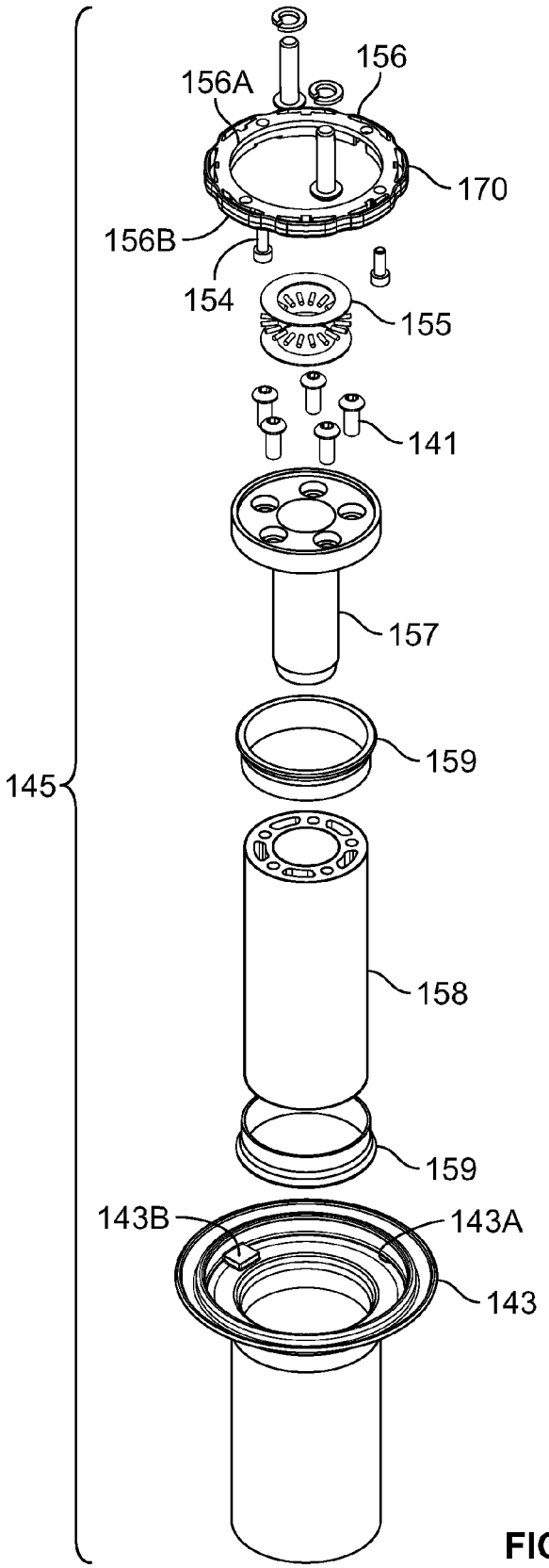
FIG. 4 is a detailed exploded view of area 145.

Now, looking at the rotatable and fixed portions of the chair, it is helpful to begin with FIGS. 8-12, which show the assembled components in section. The main fixed portion of the chair is the base portion 153. This is connected to inner extrusion 158, which may be a substantially hollow-bodied cylinder. This is attached to the base 153 via screws 152 and washers 151. Wheels 160 are optional. At the top end of the inner extrusion 158, a shaft bushing 157 is attached (using, e.g., screws 141 as shown in FIG. 4). As shown, these components together form a kind of elongate central structure. These base components are connected together and act as a fixed point on the article of furniture (chair). (It will be appreciated that, in fact, the full article of furniture/chair can be moved using the aforementioned wheels or rollers 160. But it is useful to think of these components as "fixed".) The seat components swivel/rotate relative to these base components. The seat components include chair body 112, tilt plate 126, die spring 121, and hinge bushing 119. These are mounted on a seat mount 128, which has an extended section 128A. This central extension 128A of seat mount 128 extends into the inner extrusion 158. Between the base components and seat components, a bearing assembly, in this case needle roller 155, is provided, which permits rotation between the seat and the base.

Tablet arm 140 surrounds the inner extrusion at arm meet 143 (cylindrical coupling member). The upper end of the arm meet 143 is flanged and opens toward the underside of seat mount 128. Between the arm meet 143 of tablet arm 140 and the inner extrusion 158 of the base, a pair of thrust bearings 159 (one upper, one lower, as shown) is provided. The bottom edge of the shaft bushing 157 may rest on the upper edge of the upper thrust bearing 159 as shown. These thrust bearings, which may be made, for example, of a slip-promoting plastic, allow rotation between the tablet arm 140 and the base components.

So far, we have described a rotatable seat and a rotatable tablet arm. However, the components have been described as though they rotate more or less independently of one another. In fact, there are subtle interconnections between the components that come into play. A discussion of these aspects is next.

It will be noted that the frictional resistance between the lobed friction bushing and flanged end of the tablet arm cylinder is not insurmountable. In fact, the user can still reposition the tablet arm (while sitting fixed in the seat or while rotating the seat), but the tendency promoted by the lobed friction bushing is to cause the tablet arm to follow the seat.

Attached to the underside of the seat mount 128 is a lobed friction bushing 156 (which is seen in greater detail in FIGS. 6A-6C, and further described below). This lobed friction bushing is disposed on the seat mount such that the flange of the arm meet 143 contacts the outer edges of the lobed friction bushing. Unlike the contact between the arm meet 143 and the thrust bearings 159, which encourage free movement, the bushing creates a force which frictionally resists. The frictional resistance is greater than the resistance of the swivel of the seat, so that the rotation of the seat (over 360 degrees relative to the base) leads (pulls) the tablet arm to follow it. So, the user sitting in the seat with the tablet arm moved into a comfortable working position can rotate in the seat and have the tablet arm follow (so that the tablet remains in the same working position relative to the user).

It will be noted that the frictional resistance between the lobed friction bushing and flanged end of the tablet arm cylinder is not insurmountable. In fact, the user can still reposition the tablet arm (while sitting fixed in the seat or while rotating the seat), but the tendency promoted by the lobed friction bushing is to cause the tablet arm to follow the seat.

The lobed friction bushing 156 is shown in FIGS. 6A and 6B in some detail, and in FIG. 4 with nearby components of area 145 of the overall assembly. This may be a unitary ring or disc of compressible material, or an assembly of mechanical features (e.g. springs) with the ability to exert radial force. In one embodiment, the ring or disc is of compressible plastic, however, other materials may also be used. The lobed friction bushing has a top surface 156A and a bottom surface 156B. The lobed friction bushing 156 is mounted to the seat 128 (not shown in FIG. 4) (e.g. using screws 154 through bores 173). The bottom surface 156B may be provided with slight recesses, best seen in FIG. 6B, to accommodate screw heads of screws 154. The outer surfaces of lobes 170 of the lobed friction bushing snugly engage inner diameter 143A of arm meet 143. The lobes can flex slightly into gaps 174 (seen in FIGS. 6A, 6B), but are generally biased outward for frictional engagement with the inner diameter 143A. Inserts 186 may be provided. The insert 186 may include a relatively thin, flat surface layer and a plurality of projections 190 on insert 186 (e.g. 3, shown) engage correspondingly shaped recesses in gaps 174 to provide support to these gaps 174 and prevent memory set of the material of the lobed friction bushing. The insert may be made of compressible material, or an assembly of mechanical features (e.g. springs) with the ability to exert radial force.

The inner diameter 172 of the lobed friction bushing 156 is sized to be independent of the upper end of shaft bushing 157 (which is attached to inner extrusion 158 via screws 141, which it will be recalled forms part of the "fixed" base components). The lobed friction bushing 156 does not restrict relative rotation between the seat components and the base components.

In general, the bottom surface 156B of lobed friction bushing 156 is smooth and is capable of movement within the flanged portion of arm meet 143 (by overcoming the aforementioned resistance provided by the lobes). However, in certain embodiments, a clocking element (here, tab 143B) may be provided, which acts as a stop by catching on a corresponding element attached to the seat (here, screw head of 154). When the clocking element and corresponding element catch, the tablet arm cannot be rotated further relative to the seat. This may be desirable, for example, to circumscribe an area where the tablet arm should not go (e.g. to prevent collision between the tablet arm 140 and a back portion of the seat structure 110). The "back" of the chair and the "back" of the tablet arm thus stay in sync by virtue of these features, even as the seat is rotated.

Figure 5:
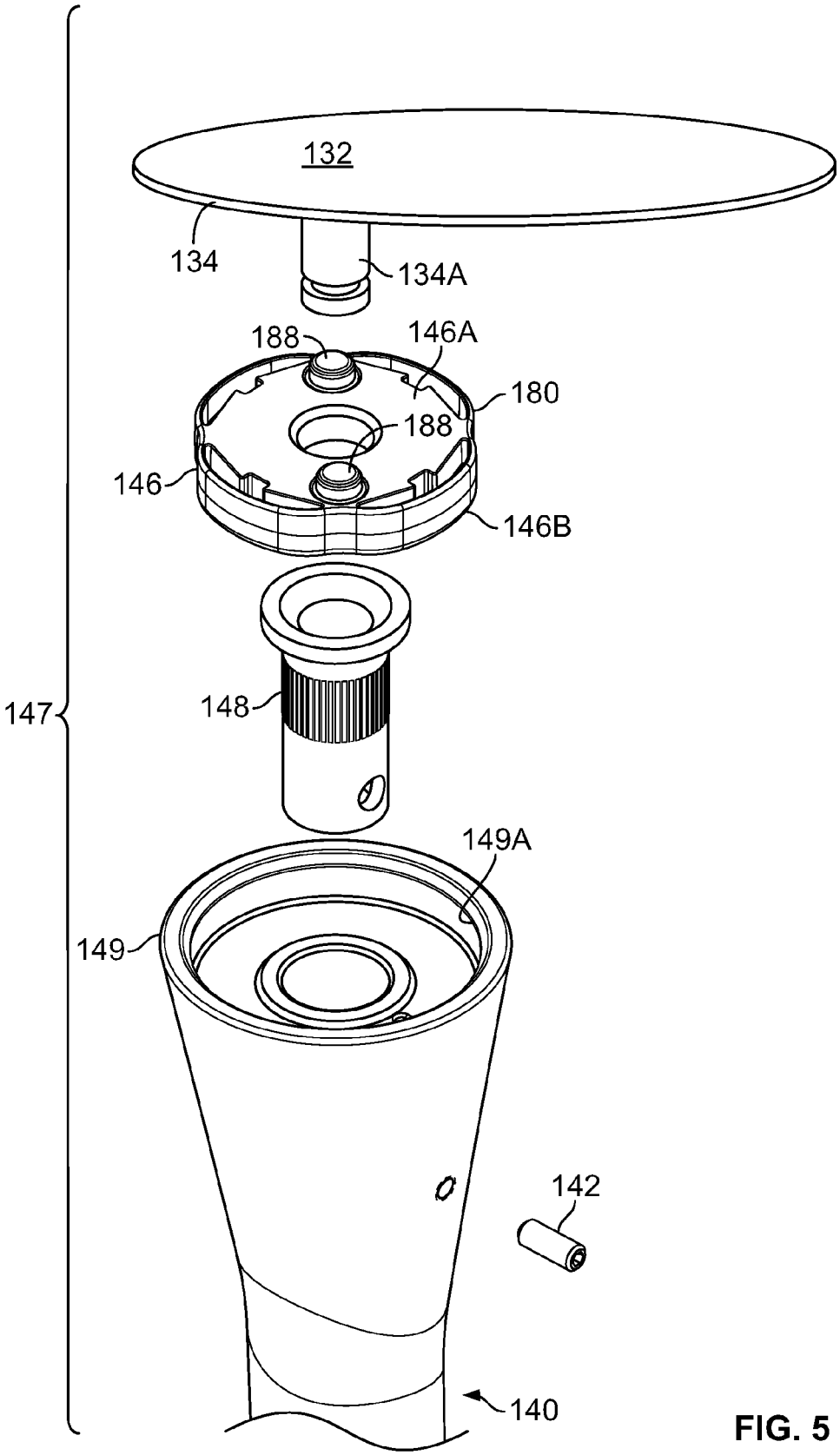
FIG. 5 is a detailed exploded view of area 147.
Figure 7A:
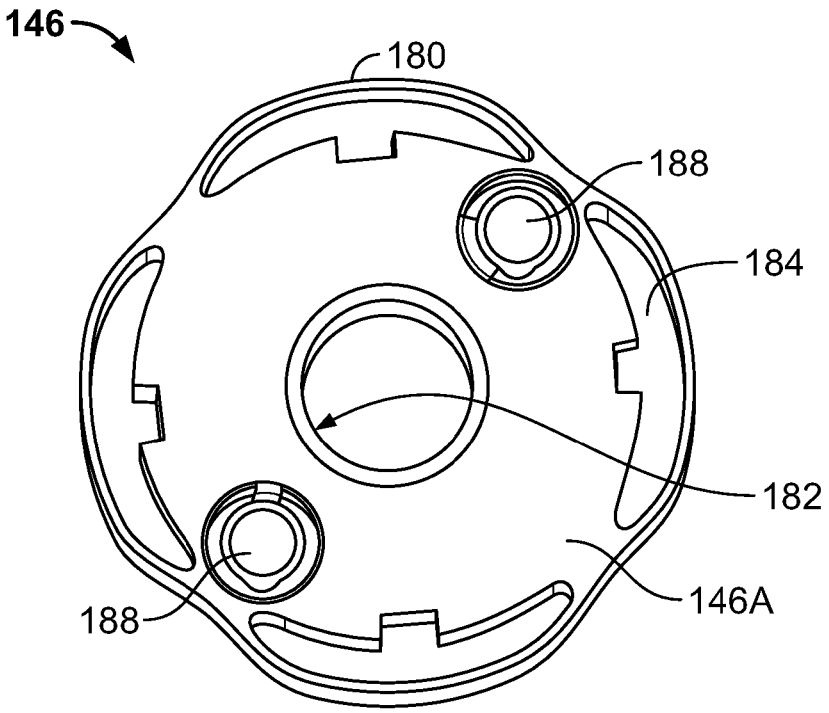
FIG. 7A is a detailed top view of a small lobed friction bushing according to a preferred embodiment.
Figure 7B:
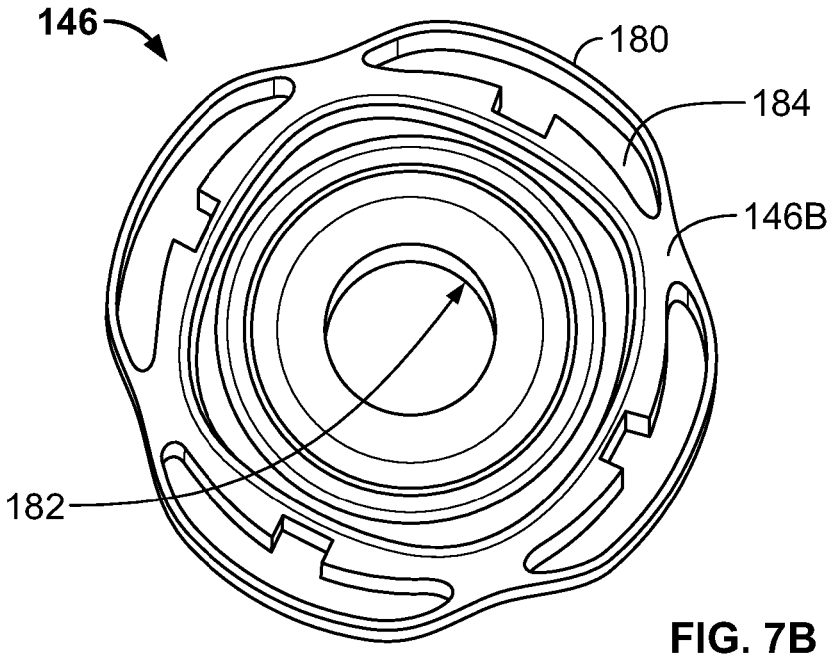
FIG. 7B is a detailed bottom view of the small lobed friction bushing.
Figure 8:
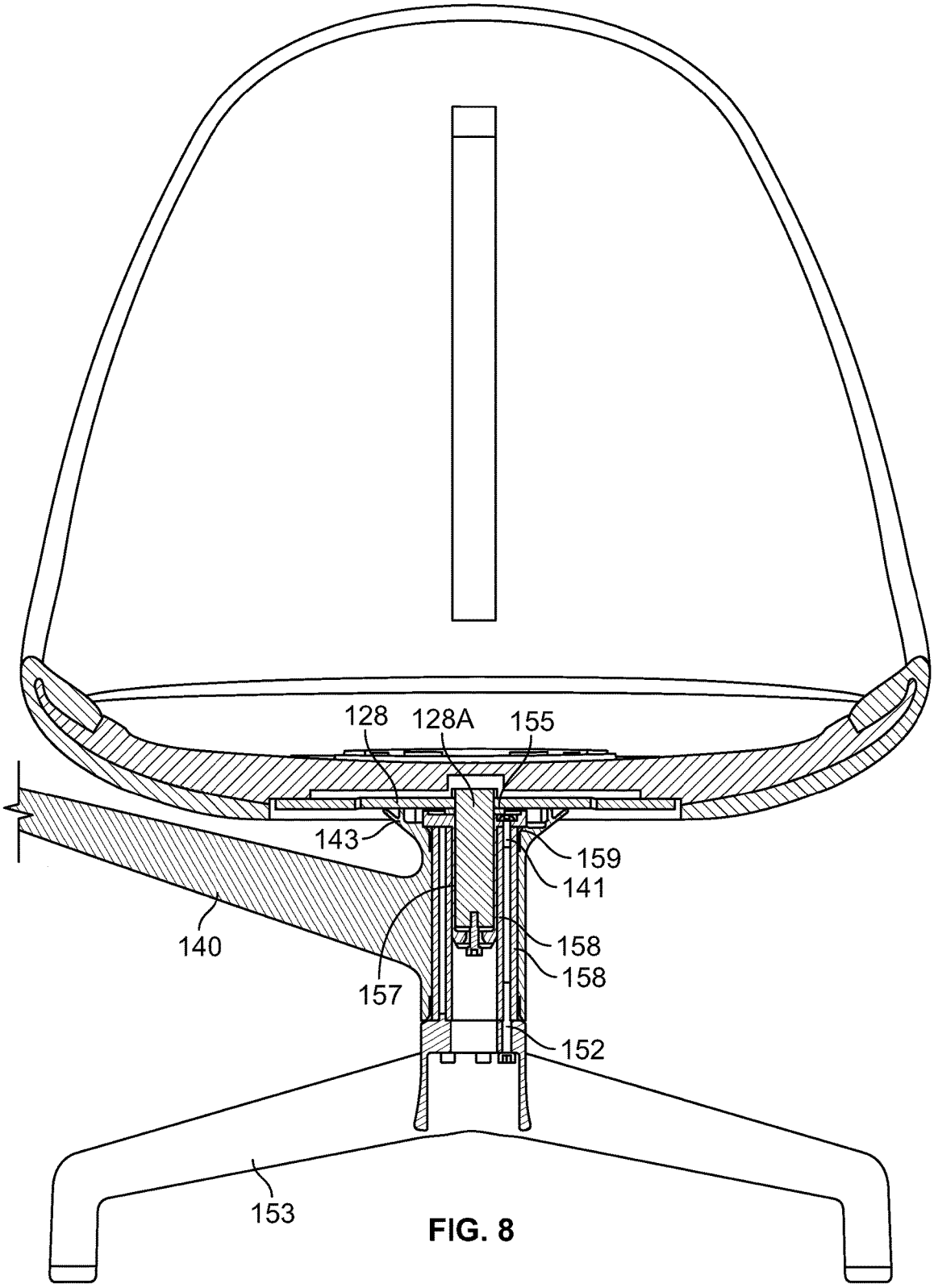
FIG. 8 is a sectional view of chair base and arm attachment assemblies.
Figure 9:
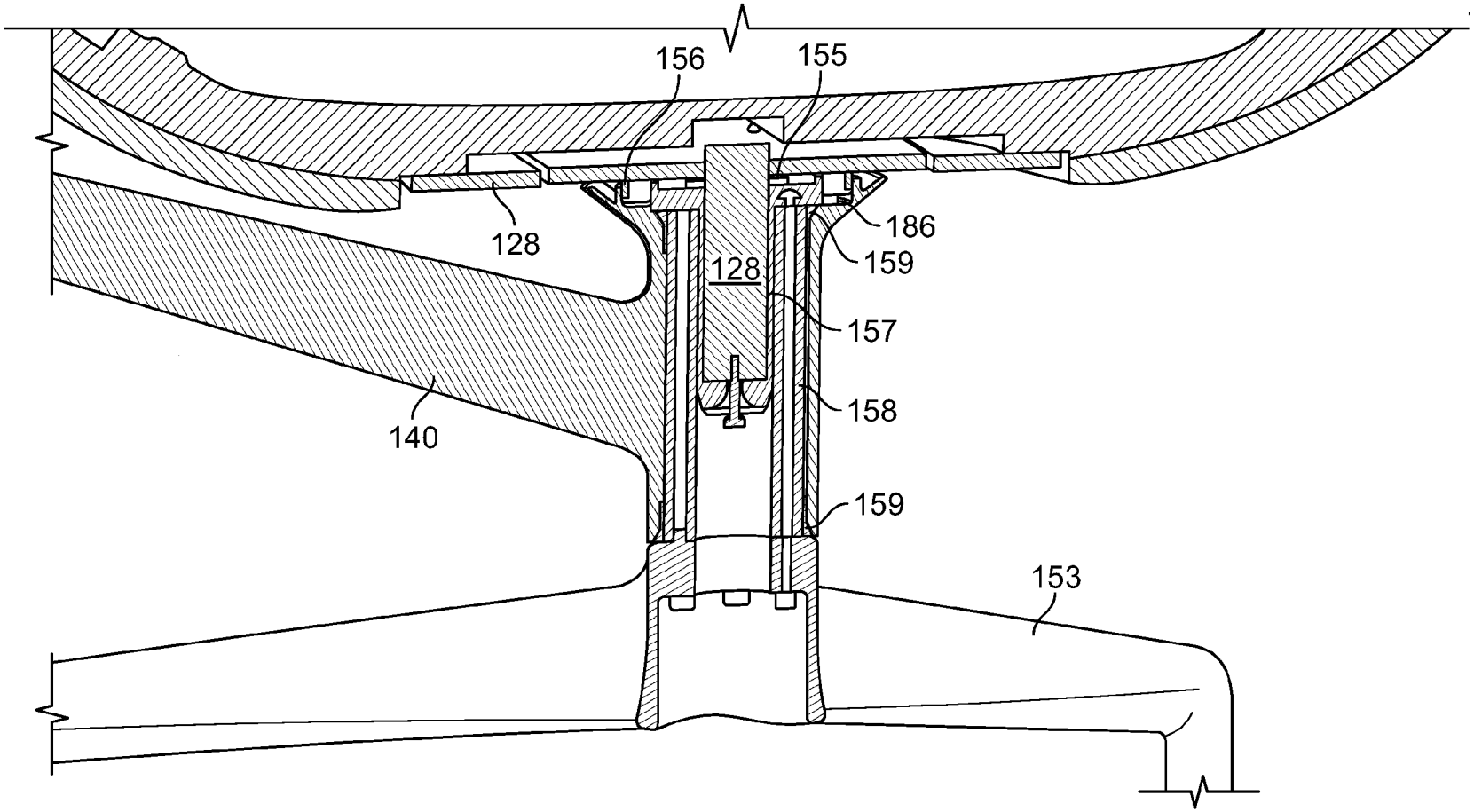
FIG. 9 is a sectional view of chair base assembly.
Figure 10:
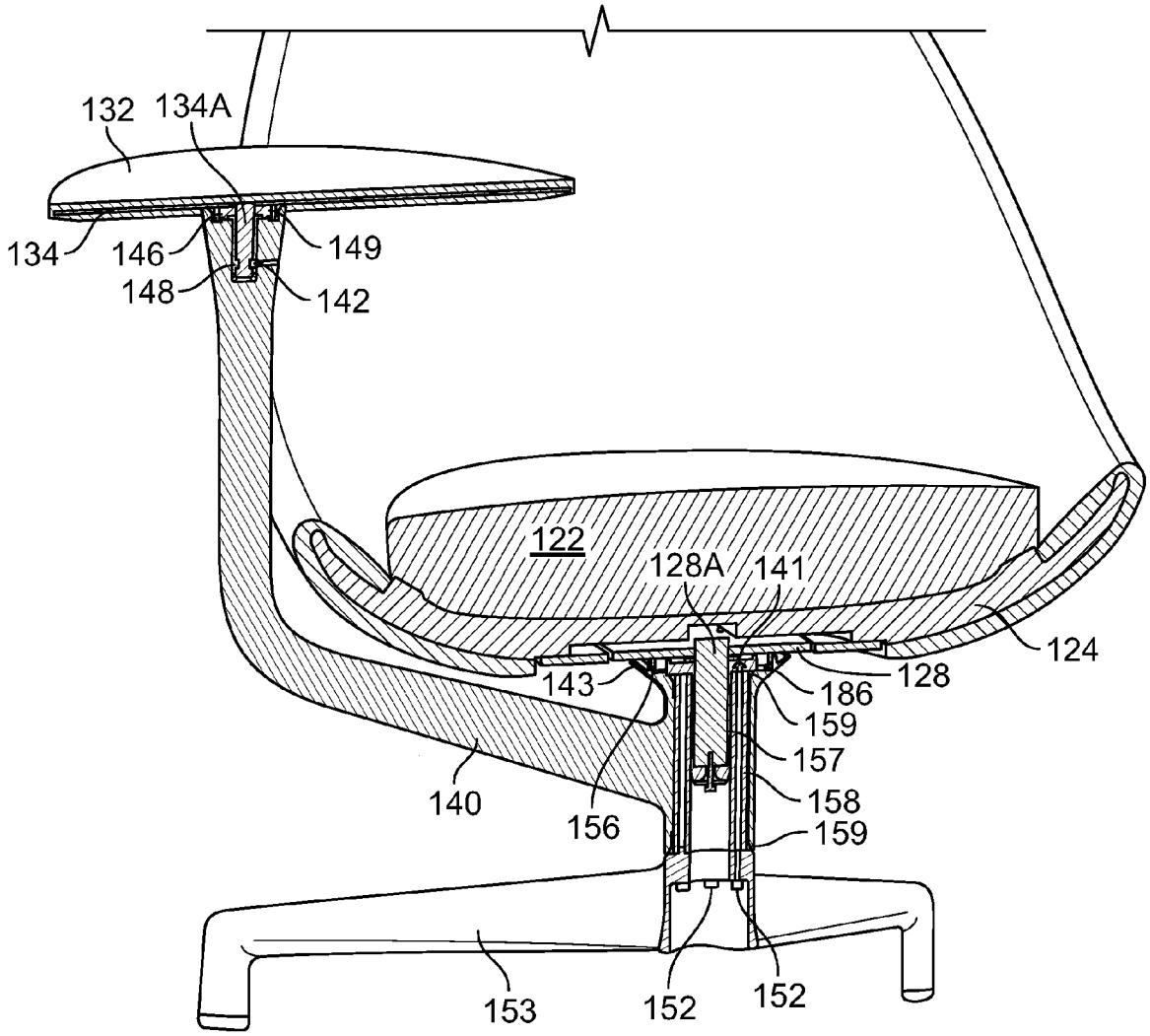
FIG. 10 is a sectional view of chair base and tablet arm assemblies.
Figure 11:
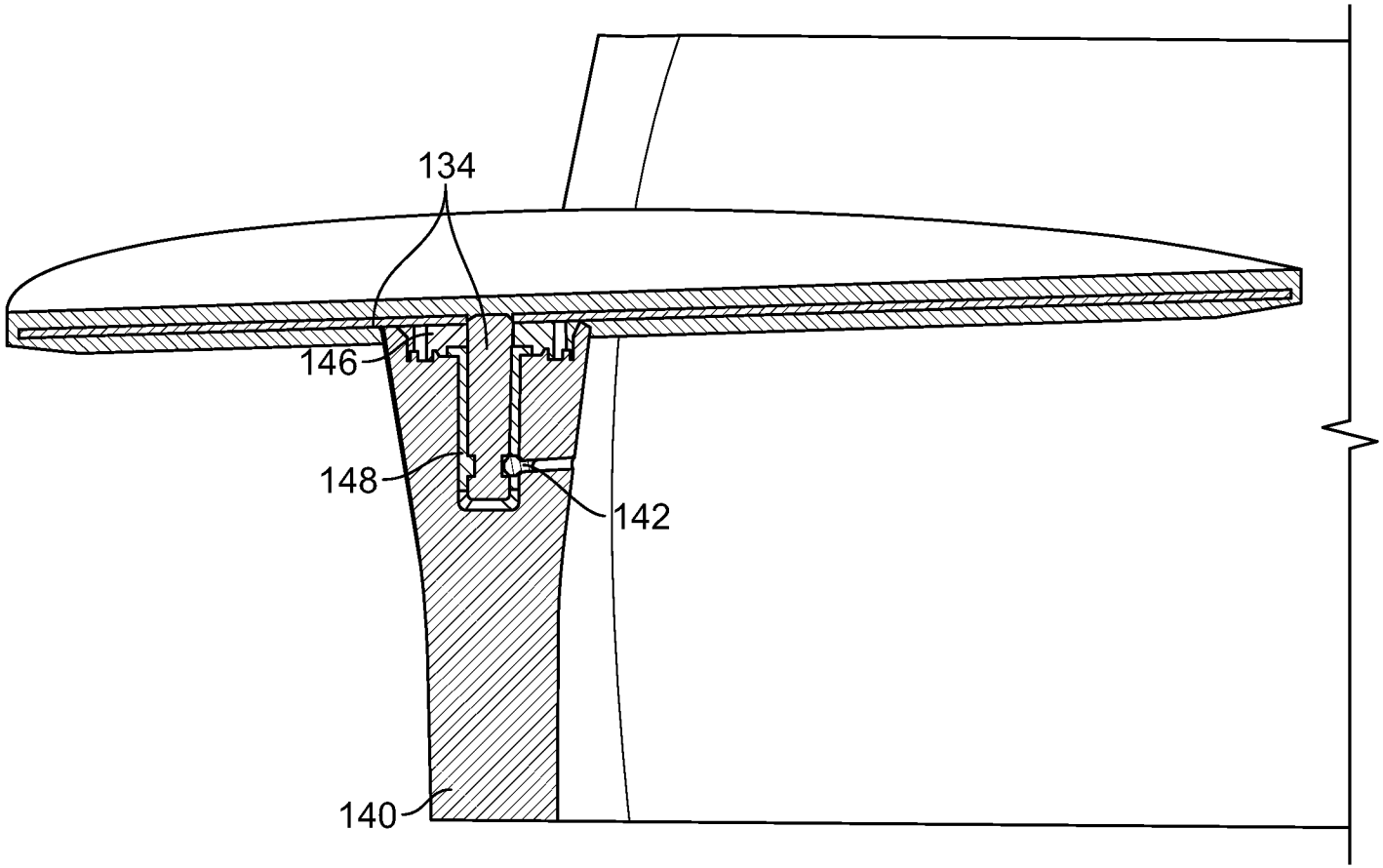
FIG. 11 is a sectional view of tablet arm assembly.
Figure 12:
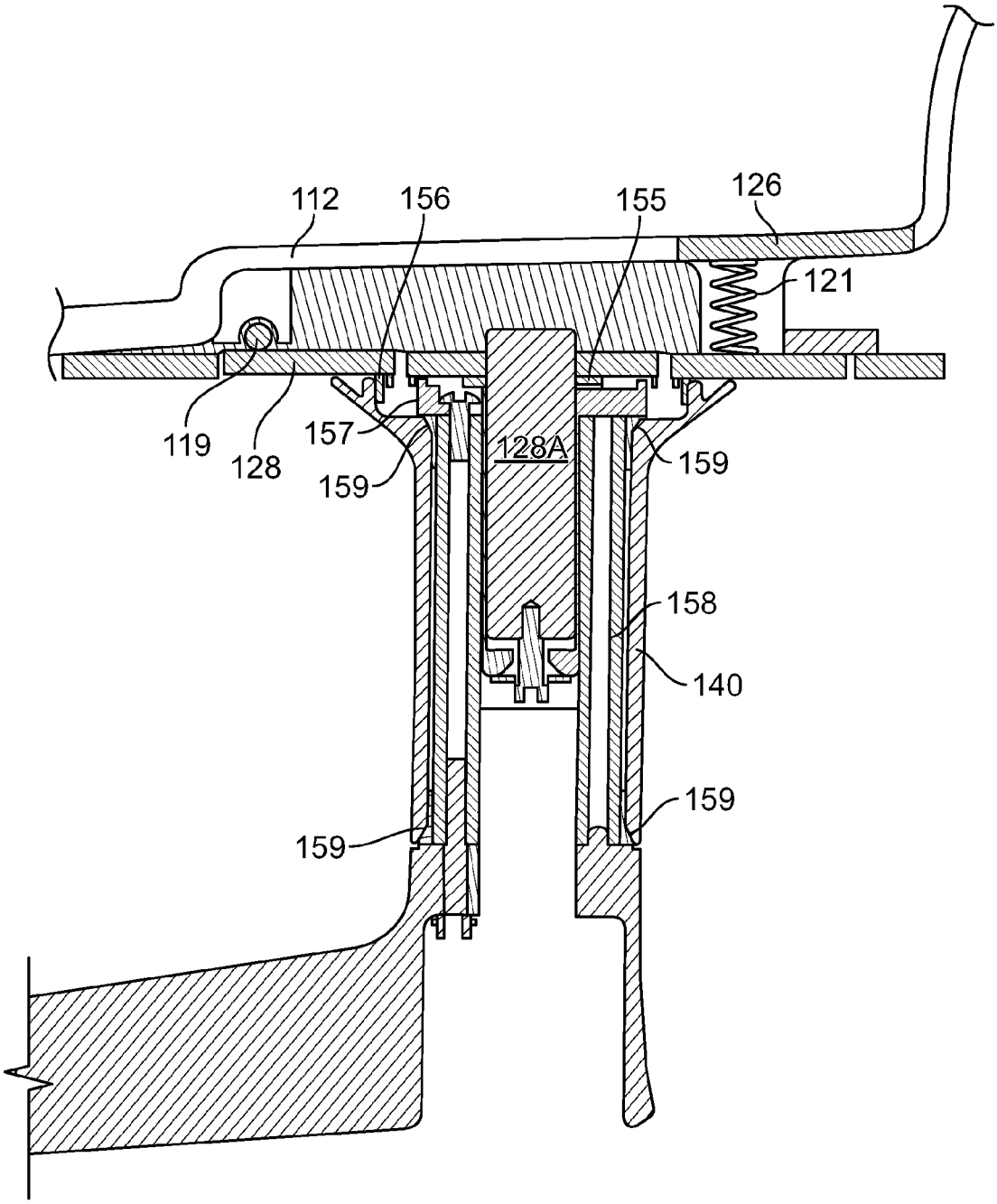
FIG. 12 is a sectional view showing rotatable seat parts, rotatable arm parts, and chair base parts.

We next turn to the construction of the tablet 130 mounted on arm 140, which bears a number of similarities to the construction coupling the arm 140 to the seat components. The components of the tablet top area 147 are shown in FIG. 5 (and assembled in section in FIG. 11). The tablet top 132 is attached to a tablet weldment 134. This is roughly similar to the structure of the seat mount 128. The tablet weldment has an extension 134A, which extends through a central opening in tablet shoulder bushing 148 (similar to shaft bushing 157) and in turn through a central opening of tablet arm 140 at tablet meet 149. A screw/pin 142 passes through an opening in the tablet shoulder bushing 148 and engages a groove in extension 134A of tablet weldment. A small lobed friction bushing 146 is provided attached to the underside of tablet weldment 134 (nubs 188 may engage corresponding holes in the tablet weldment (not shown) to prevent relative rotation). The extension 134A of the tablet weldment passes through inner diameter 182 of the small lobed friction bushing 146. Bottom surface 146B of lobed friction bushing 146 (opposite top surface 146A) sits inside the tablet meet 149, where lobes 180 engage inner diameter 149A. Tablet shoulder bushing 148 is preferably made of a non-frictional material (which may be self-lubricating) allowing it to provide a relatively smooth surface for rotation of the tablet top 132 but for the resistance provided by the lobed friction bushing.

As per the previously described large friction bushing 156, the small lobed friction bushing 146 may be made up of a unitary disc or ring having outer lobes 180 which are slightly flexed into gaps 184. This may be a unitary ring or disc of compressible material, or an assembly of mechanical features (e.g. springs) with the ability to exert radial force. In one embodiment, the ring or disc is of compressible plastic, however, other materials may also be used. These lobes 180 bias against the inner diameter of the tablet meet to provide frictional resistance. This frictional resistance means that the rotation of the tablet arm 140 (over 360 degrees or whatever smaller arc of rotation may be circumscribed based on the clocking element) leads (pulls) the tablet top 132 to follow it. So, the user sitting in the seat can position the tablet top in a desired orientation (by rotating the tablet top relative to the arm), and then that orientation is retained. In other words, rotating the tablet arm to another position will cause the tablet top to follow (so that the relative orientation of the tablet top remains consistent despite rotation of the arm).

The frictional resistance between the small lobed friction bushing 146 and flanged end of the tablet meet 149 is not insurmountable. In fact, the user can still reposition the tablet (in any position of the tablet arm), but the tendency promoted by the lobed friction bushing is to cause the tablet to follow the tablet arm (i.e. hold the tablet in a chosen position as the tablet arm is rotated).

In order to promote comprehension of the components of the present specification, relative terms such as up, down, upper, lower, left, right, top, bottom, inner, outer, and so forth, have been used (generally for consistency with the orientations of the components as shown in the figures). It will be appreciated that these may, in some cases, be subject to overall orientation of the furniture article (chair) and are not intended to state absolutes.

The scope of the claims should not be limited by the preferred embodiments set forth in the foregoing disclosure, but should be given the broadest purposive construction consistent with the description as a whole and having regard to equivalents set forth or implied.

The invention claimed is:

1. An article of furniture comprising:

a seat having a first surface to face a user and a second surface opposite the first surface;

a base having a base portion and an elongate central structure;

a bearing assembly between the elongate central structure of the base and the seat, the bearing assembly permitting rotation between the seat and the base;

a tablet;

a tablet arm connected to the tablet with a first cylindrical member and to the elongate central structure of the base with a second cylindrical member; and the second cylindrical member being disposed around the elongate central structure with a flange at the upper end thereof;

wherein the seat has a lobed friction bushing on the second surface, disposed such that the flange of the second cylindrical member contacts the lobed friction bushing and frictionally resists rotation of the tablet arm as the seat rotates 360 degrees relative to the base, leading the tablet to follow the seat as it rotates.

2. The article of furniture of claim 1, wherein the tablet arm comprises a clocking element on the second cylindrical member, the clocking element catching on at least one element attached to the second surface of the seat for retaining the relative orientation of the tablet as the seat rotates.

3. The article of furniture of claim 1, wherein the tablet arm is rotatable over 360 degrees.

4. The article of furniture of claim 2, wherein the tablet arm is rotatable within a range circumscribed by the at least one element on the seat.

5. The article of furniture of claim 1, wherein the tablet has a first surface facing the user and a second surface opposite the first surface, a lobed friction bushing being disposed on the second surface of the tablet such that a flange at an upper end of the first cylindrical member contacts this lobed friction bushing and frictionally resists rotation of the tablet as the tablet arm is rotated relative to the base, leading the tablet to follow the tablet arm as it rotates.

6. The article of furniture of claim 1, wherein the tablet is movable independently of the rotation of the seat.

7. The article of furniture of claim 1, wherein a relative position of the tablet is maintained as the seat rotates.

8. The article of furniture of claim 4, wherein the tablet arm is rotatable across a range from right to left.

9. The article of furniture of claim 4, wherein the tablet arm is rotatable into a position top dead centre of the position of the user.

10. The article of furniture of claim 4, wherein the tablet arm is rotatable to a position behind the user.

11. The article of furniture of claim 1, wherein the lobed friction bushing has a ring or disc shape, which has a plurality of radially outwardly extending compressible lobes around its perimeter, at least an outer portion of each lobe engaging with an interior diameter of the flange.

12. The article of furniture of claim 11, wherein the lobed friction bushing further comprises at least one insert having a flat surface layer and a plurality of projections extending proud therefrom, each said projection engaging a gap within a corresponding lobe on the unitary ring or disc to support and prevent memory set of the lobe.

* * * * *